US007050541B2

(12) United States Patent
Bittl

(10) Patent No.: US 7,050,541 B2
(45) Date of Patent: May 23, 2006

(54) X-RAY TUBE WITH LIQUID-METAL FLUID BEARING

(75) Inventor: Herbert Bittl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/828,577

(22) Filed: Apr. 21, 2004

(65) Prior Publication Data

US 2004/0213379 A1 Oct. 28, 2004

(30) Foreign Application Priority Data

Apr. 22, 2003 (DE) ..... 103 18 194

(51) Int. Cl.
*H01J 35/26* (2006.01)

(52) U.S. Cl. ..... 378/132

(58) Field of Classification Search ..... 378/125, 378/127, 129, 130, 132, 133, 136, 141, 144
See application file for complete search history.

(56) References Cited

U.S. PATENT DOCUMENTS

| | | | | |
|---|---|---|---|---|
| 4,949,369 | A | 8/1990 | Bittl | 378/130 |
| 5,541,975 | A * | 7/1996 | Anderson et al. | 378/130 |
| 6,327,340 | B1 * | 12/2001 | Runnoe | 378/130 |
| 6,430,260 | B1 * | 8/2002 | Snyder | 378/130 |
| 2002/0085676 | A1 | 7/2002 | Snyder | |

FOREIGN PATENT DOCUMENTS

| | | |
|---|---|---|
| DE | 195 23 162 | 1/1996 |

* cited by examiner

*Primary Examiner*—Craig E. Church
*Assistant Examiner*—Jurie Yun
(74) *Attorney, Agent, or Firm*—Schiff Hardin LLP

(57) ABSTRACT

An x-ray tube has a stationary cathode and a rotating anode in a vacuum housing. The anode is positioned on a housing-fixed axle such that it can be rotated, and is fashioned as a hollow body in the interior of which an axle-fixed ring projection is disposed, such that, at least between an inner surface of the rotating anode and the adjacent outer surface of the ring projection, a gap exists that is filled with liquid metal and forms a liquid-metal fluid bearing for the rotating anode.

10 Claims, 1 Drawing Sheet

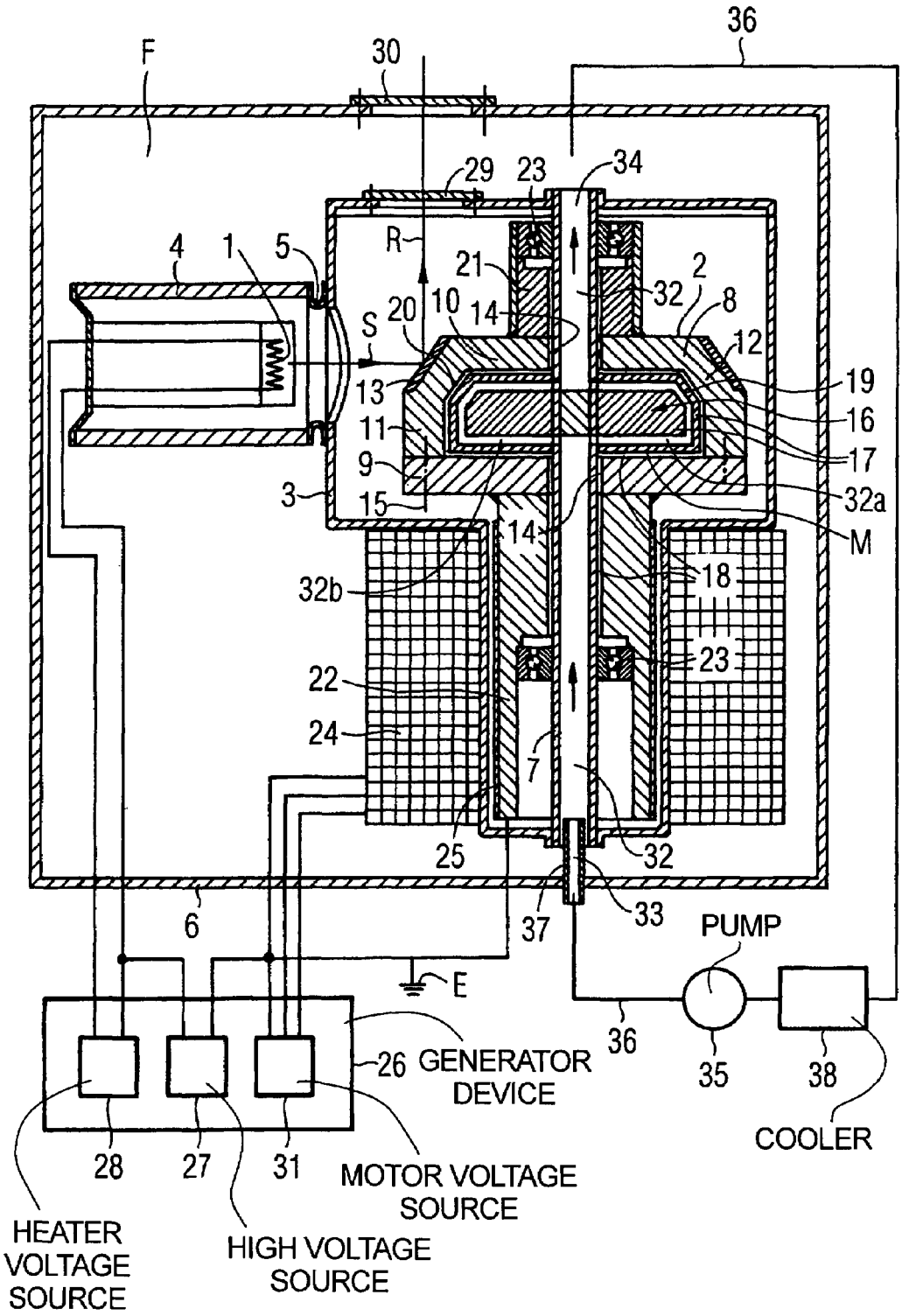
36
F
30
29
23
34
R
4
1
5
21
2
32
8
S
20
10
14
12
13
19
11
16
9
17
3
15
32a
14
M
32b
18
23
22
24
7
25
32
6
37
33
PUMP
E
36
35
38
26
GENERATOR DEVICE
COOLER
28
27
31
MOTOR VOLTAGE SOURCE
HEATER VOLTAGE SOURCE
HIGH VOLTAGE SOURCE

X-RAY TUBE WITH LIQUID-METAL FLUID BEARING

BACKGROUND OF THE INVENTION

1. Field of the Invention

The present invention concerns an x-ray tube of the type having a stationary cathode and a rotating anode in a vacuum housing, the anode being positioned on a housing-fixed axle such that it can be rotated, and the rotating anode being formed as a hollow body with an interior an axle-fixed ring projection is disposed.

2. Description of the Prior Art

X-ray radiation conventionally is generated by bombarding an anode with an electron beam originating from a cathode. The cathode and the anode are arranged in a vacuum housing. The anode typically is a rotating anode that rotates under the incident electron beam in order to prevent the focal spot from being stationary with respect to the anode. The focal spot, meaning the point at which the electron beam strikes the anode surface, moves (when viewed in the context of a coordinate system rotating with the rotating anode) along a circular path over the anode surface. The heat generated by the impact of the electron beam thus is relatively uniformly distributed on the anode surface for countering material overheating in the focal spot.

Bearing requirements for such a rotating anode are significant because the anode is frequently operated with high angular rotation speeds and acceleration rates, and correspondingly high angular acceleration can occur. Additionally, an optimally good heat dissipation from the rotating anode must be ensured in order to prevent overheating of the x-ray tube.

An x-ray tube of the initially cited type is known from European Application 0 328 951. In this known x-ray tube, the rotating anode is rotatably positioned on a housing-fixed axle passing completely through it. The bearing ensues with roller bearings arranged on both sides of the rotating anode in the axial direction. For a good heat removal, the rotating anode is formed as a hollow body in the interior of which an axle-fixed heat absorption body, through which coolant flows, is disposed. The rotating anode and the heat absorption body are separated by a thin gap via which heat is radiated from the rotating anode onto the heat absorption body.

An x-ray tube with a rotating anode driven by a central drive axle is known from United States Patent Application Publication No. 2002/0085676. The drive axle is supported by ball bearings in a tube-like guide. The guide in turn is surrounded by a heat exchanger disposed in the hollow rotating anode such that, between the inner wall of the rotating anode and an adjacent wall of the heat exchanger, a gap is formed that is filled with a fluid heat transfer medium, in particular a liquid metal, for the effecting of a good heat coupling to the rotating anode.

Furthermore, for example from German OS 195 23 162, it is known to use a liquid-metal fluid bearing for the rotating anode of an x-ray tube.

SUMMARY OF THE INVENTION

An object of the present invention is to provide an x-ray tube having a basic structure as initially described, wherein a particularly good cooling and a particularly efficient bearing of the rotating anode are achieved with simple means.

This object is inventively achieved by an x-ray tube having a rotating anode fashioned as a hollow body, in the interior of which an axle-fixed ring projection is disposed. A gap filled with liquid metal is formed between the inner surface of the rotating anode facing the interior and the adjacent outer surface of the ring projection. The gap width and the surface property of the walls bordering the gap are designed such that the rotating anode and the ring projection therein form a liquid-metal fluid bearing together with the liquid metal contained in the gap. The gap is thus fashioned as a bearing gap.

Due to the relatively large adjacent bearing surfaces achieved by the arrangement of the ring projection in the rotating anode, both radial forces and axial forces are absorbed in a superb manner, and a particularly low-friction bearing of the rotating anode is ensured.

At the same time, the liquid metal film in the gap effects a particularly good heat transfer from the rotating anode to the ring projection. The relatively large area of the bearing surfaces and the good mixing of the liquid metal film given rotation of the rotating anode likewise contribute to this. Furthermore, the liquid metal film in the gap serves for simple and particularly effective electrical contacting of the rotating anode, for example via the axle that is connected to ground.

For further improvement of the bearing effect, the gap filled with liquid metal extends not only between the ring projection and the adjacent inner wall of the rotating anode, but also, starting from the rotating anode, extends at least on one side to a continuation region disposed around the axle.

A metallic sleeve that is separated from the rotating anode in the axial direction and that concentrically surrounds the axle preferably is attached to the rotating anode. The sleeve serves for an improved radial bearing of the rotating anode, by allowing the gap filled with liquid metal to be elongated from the region of the rotating anode to the region of the sleeve. The sleeve also preferably is used as a rotor of an electromotor the magnet coil (stator) of which is arranged outside of the vacuum housing. In this manner, a compact, particularly simple rotating drive for the rotating anode is achieved that in particular enables a contact-free force transfer through the vacuum housing.

In a preferred, structurally simple embodiment, the rotating anode has an annular shape with an essentially U-shaped ring cross-section open at the axle. The rotating anode is formed with relatively thin walls and thus has a small rotational moment of inertia, which enables a short starting time. An outer edge of the approximately U-shaped cross-section is canted in a conventional manner to form a target surface for the electron beam. The target surface of the rotating anode thus forms a region that conically tapers in the axial direction. This enables a stable two-sided attachment of the axle to the vacuum housing and a particularly good bearing of the rotating anode, as well as a simple installation of a circulation coolant circuit within the axle.

For this latter purpose, the axle and the ring projection preferably have a coolant channel passing through them that, at least in the ring projection, runs closely beneath the outer surface to ensure good heat dissipation. Moreover, in the projection the coolant channel can branch into a number of sub-channels. For particularly good heat removal, the ring projection preferably is formed of a good heat-conductive material.

An advantage achieved with the invention is that the rotating anode is approximately centrally mounted, meaning that its geometrical center is close to its center of mass. With such a simple and compact design, high centrifugal forces can be absorbed without requiring additional bearings disposed externally of the rotating anode. Nevertheless, optional additional bearings, for example roller bearings, can be provided.

DESCRIPTION OF THE DRAWINGS

The single FIGURE is a schematic sectional view of an x-ray tube with a rotating anode supported by a liquid-metal fluid bearing on a housing-fixed axle in a vacuum housing, in accordance with the invention.

DESCRIPTION OF THE PREFERRED EMBODIMENTS

The x-ray tube shown in the FIGURE has a stationary cathode 1 and a rotating anode 2. The rotating anode 2 is disposed in a stationary vacuum housing 3. The cathode 1 is disposed in an isolator housing 4 that is vacuum-sealed to the vacuum housing 3 by means of a metal ring 5. The vacuum housing 3 is disposed in a protective housing 6 that is filled with an electrically insulating liquid F, for example insulating oil.

A housing-fixed axle 7 extends completely through the vacuum housing 3, on which the rotating anode 2 is mounted such that it can rotate. The axle 7 is vacuum-sealed at both ends by the wall of the vacuum housing 3.

The rotating anode 2 is rotationally symmetric with regard to the axle 7. It has a tank-like or shell-like first part that is subsequently designated as a tank 8. The tank 8 is terminated on an open side thereof by a flat, radially aligned second part that is subsequently designated as a cover 9. The tank 8 has a radially aligned base 10, a substantially cylindrical side wall 11 that is concentric with regard to the axle 7, and a transfer area 12, between the base 10 and the side wall 11, that is canted approximately at an angle of 45° with regard to the base 10 and the side wall 11. The transfer area 12 thus exhibits approximately the shape of a frustrum, coaxial with regard to the axle 7, that conically tapers toward the base 10. The transfer area 12 is provided on the outside with a layer 13 made from a tungsten-rhenium alloy that serves as a target surface for an electron beam S, from which an x-ray beam R is generated. Both parts of the rotating anode 2, meaning the tank 8 and the cover 9, are provided with a central bore 14 in which the axle 7 is disposed with little play motion (free motion). The tank 8 and the cover 9 preferably are screwed together with screws or bolts 15 (schematically shown). Alternatively, the tank 8 and the cover 9 can be welded or soldered together. The rotating anode 2 thus is fashioned as an annular hollow body with an approximately U-shaped cross-section that is open toward the axle 7.

A rotationally symmetric ring projection 17 connected rigidly with the axle 7 is disposed in the interior 16 enclosed by the rotating anode 2. The ring projection 17 almost completely fills the interior 16, and between the ring projection 17 and the rotating anode 2 only a narrow gap 18 is formed that is bordered on one side by the outer surface 19 of the ring projection 17 and on the other side by the inner surface 20 of the rotating anode 2. The gap 18 is filled with a liquid metal M, in particular gallium or a gallium alloy, to form a fluid bearing.

The respective axial ends of the rotating anode 2 (meaning at the base 10 and the cover 9) are connected, such as by welding or soldering, with sleeves 21 and 22. The sleeves 21 and 22 each surround the axle 7, as an axial extension of the rotating anode 2, concentrically and with little play. The gap 18 filled with liquid metal M extends over the area between the inner surface 20 of the rotating anode 2 and the outer surface 19 of the ring projection 17 and into an axial continuation surrounding the axle 7 and reaching into the area of the sleeves 21 and 22. The gap 18 is formed at the latter region by the play between the respective sleeves 21, 22 and the axle 7.

Leakage of the liquid metal M from the gap 18 is prevented in a known manner (for example, as specified in German OS 195 23 162), by the axial edge regions of the gap being made anti-wetting for the liquid metal M, for example by coating with titanium oxide ($TiO_2$). The bearing of the rotating anode 2 ensues solely by the gap 18 filled with liquid metal M, that by itself ensues an effective bearing.

As an optional addition, each sleeve 21, 22 can include a roller bearing 23. The roller bearings 23 are provided as a secondary bearing to improve the overall bearing, if necessary.

The sleeve 22 simultaneously serves for rotational actuation of the rotating anode 2, by serving as a rotor that interacts with a stator 24 disposed outside of the vacuum housing 3 to form an electromotor. To produce or improve the electrical properties necessary for a rotor, a suitable rotor coating 25 (for example copper) is optionally applied on the exterior of the sleeve 22.

To generate the x-ray beam, high voltage is applied between the cathode 1 and the anode 2. The high voltage is provided by a high voltage source 27 in a generator device 26 (schematically shown). The contacting of the rotating anode 2 ensues via the vacuum housing 3 connected to ground E, the axle 7 conductively connected therewith, and the liquid metal film in the gap 18. The generator device 26 furthermore has a heater voltage source 28, which is connected to the cathode 1 to generate a heating voltage. The cathode 1 heated in the operation of the x-ray tube by the application of the heating voltage emits electrons to form the electron beams S, that are accelerated by the effect of the high voltage in the direction of the rotating anode 2, meaning in particular perpendicular to the axle 7, and strike the anode 2 in the region of the layer 13 disposed slanted relative to the beam propagation direction. The x-ray beam R thus generated (schematically shown by a ray directed in the axial direction) exits the vacuum housing 3 and the protective housing 6 via respective radiation windows 29 and 30 (positioned axially aligned in the beam path and transparent for x-ray radiation R) of the vacuum housing 3 and the protective housing 6. Aside from the radiation window 30, the protective housing 6 is covered with or formed by a radiation shielding material, for example lead, to weaken undesired scatter radiation.

In the operation of the x-ray tube, the rotating anode 2 is driven by means of the electromotor formed by the sleeve 22 and the stator 24 such that it rotates, and the layer 13 thus rotates with regard to the incident electron beam S and the heat generated by the electron bombardment is annularly distributed on the circumference of the rotating anode 2. The electromotor is supplied with voltage by a voltage source 31 of the generator device 26.

The heat in the rotating anode 2 is very effectively transferred via the liquid metal film in the gap 18 to the ring projection 17, which for this purpose is composed of a good heat-conducting material. To dissipate the heat from the vacuum housing 3, a coolant channel 32, which can be fed with a coolant runs within the axle 7 and the ring projection 17. The fluid F is used as the coolant. The coolant channel 32 branches in the region of the ring projection 17 into a number of sub-channels, of which two (namely the sub-channels 32*a* and 32*b*) are visible in the FIGURE. These are directed along close to the outer surface 19 of the ring projection 17 in order to ensure an effective heat removal. The coaxial course of the coolant channel 32 is blocked within the ring projection 17, such that flow-through in the sub-channels 32*a*, 32*b* is enforced.

As can be seen in the FIGURE by the arrows indicating the flow direction in the coolant channel 19, one end of the axle 7 forms an in-flow (inlet) opening 33 of the coolant channel 32, while an out-flow (inlet) opening 34 is located at the opposite end of the axle 7. For this, the axle 7 is projected out of the vacuum housing 3 such that the in-flow opening 33 and the out-flow opening 34 are open to the interior of the protective housing 6. The coolant channel 32 thus is in fluid communication with the fluid-filled protective housing 6.

The fluid flow necessary for cooling is generated by means of a schematically indicated pump 35 that is connected in a schematically indicated coolant line 36. The coolant line 36 begins inside of the protective housing 6, close to the out-flow opening 34, and ends in a pipe socket 37 connected with the protective housing 6 and protruding into the in-flow opening 33 of the coolant channel 32. The fluid F used as coolant is thus suctioned in by the pump 35, proceeds through a cooler 38 circuited in the coolant line 36, and is fed to the coolant channel 32 by the pipe socket 37. As a result of the loose (in particular non-fluid-sealed) connection between the coolant line 36 and the coolant channel 32, a partial mixing of the fluid F flowing in the coolant line 36 and the coolant channel 32 and the fluid F at rest in the protective housing 6 ensues, so a gradual fluid exchange is ensured between the protective housing 6 and the coolant channel 32.

Insofar as a cooler is not necessary, the coolant circuit can also ensue (in a manner not shown) inside the protective housing 6. A pump is then provided in the interior of the protective housing 6 that feeds the fluid located in the protective housing 6 into the in-flow opening 33 of the coolant channel 32 to generate a fluid flow.

Although modifications and changes may be suggested by those skilled in the art, it is the intention of the inventor to embody within the patent warranted hereon all changes and modifications as reasonably and properly come within the scope of his contribution to the art.

I claim:

1. An x-ray tube comprising:

a vacuum housing;

a stationary cathode disposed in said vacuum housing;

an axle fixedly attached to said vacuum housing and proceeding through an interior of said vacuum housing;

a ring projection fixed to said axle, and having an outer surface;

a rotating anode formed by a hollow body surrounding said axle and having an interior, having an inner surface, in which said ring projection is disposed with a gap existing between said inner surface of said interior of said hollow body and said outer surface of said ring projection; and a liquid metal film filling said gap forming with said gap a liquid-metal fluid bearing for said rotating anode, allowing rotation of said hollow body around said axle.

2. An x-ray tube as claimed in claim 1 wherein said hollow body has body walls disposed adjacent said axle, and wherein said gap filled with said liquid metal continues between said body walls and said axle.

3. An x-ray tube as claimed in claim 2 comprising at least one sleeve connected to one of said body walls and concentrically surrounding said axle with a radial spacing from said axle.

4. An x-ray tube as claimed in claim 3 wherein said gap filled with said liquid metal continues into said radial spacing between said at least one sleeve and said axle.

5. An x-ray tube as claimed in claim 3 comprising a stator mounted at an exterior of said vacuum housing, and wherein said sleeve forms a rotor, said stator and said rotor interacting to form an electromotor for driving said rotating anode.

6. An x-ray tube as claimed in claim 1 wherein said hollow body is annular and has a substantially U-shaped cross section.

7. An x-ray tube as claimed in claim 1 wherein said axle passes completely through said rotating anode.

8. An x-ray tube as claimed in claim 1 further comprising a channel for coolant proceeding in said axle and in said ring projection.

9. An x-ray tube as claimed in claim 8 wherein said channel in said ring projection is disposed next to said outer surface of said ring projection.

10. An x-ray tube as claimed in claim 8 wherein said channel in said ring projection comprises a plurality of branched sub-channels.

* * * * *